US006808409B2

(12) United States Patent
Held et al.

(10) Patent No.: US 6,808,409 B2
(45) Date of Patent: Oct. 26, 2004

(54) ELECTRICAL CONNECTOR HAVING GUIDE AND CENTERING AID

(75) Inventors: Ernst Held, Waiblingen (DE); Wolfgang Schneid, Steinheim (DE); Peter Zweigle, Ditzingen (DE)

(73) Assignee: Robert Bosch GmbH, Stuttgart (DE)

( * ) Notice: Subject to any disclaimer, the term of this patent is extended or adjusted under 35 U.S.C. 154(b) by 326 days.

(21) Appl. No.: 09/742,980

(22) Filed: Dec. 20, 2000

(65) Prior Publication Data

US 2001/0021604 A1 Sep. 13, 2001

(30) Foreign Application Priority Data

Dec. 23, 1999 (DE) ..... 299 22 718 U

(51) Int. Cl.[7] ..... H01R 13/64
(52) U.S. Cl. ..... 439/378
(58) Field of Search ..... 439/378, 247, 439/248

(56) References Cited

U.S. PATENT DOCUMENTS 6,017,233 A * 1/2000 Fry et al. ..... 439/248
6,155,857 A * 12/2000 Kato et al. ..... 439/248
6,234,817 B1 * 5/2001 Hwang ..... 430/247
6,358,067 B1 * 3/2002 Takase et al. ..... 439/79

* cited by examiner

*Primary Examiner*—Alexander D. Gilman
(74) *Attorney, Agent, or Firm*—Kenyon & Kenyon

(57) ABSTRACT

An improved guidance of a plug connector in a mating connector, particularly of a cable-harness plug connector into a multipoint connector, during the insertion and positioning process, is provided. At least one recess is disposed on the mating connector and is dimensioned in such a way that, during the insertion of the plug connector into the mating connector, guide element is guided in the recess, and in the inserted state, the recess is set apart from the guide element.

6 Claims, 2 Drawing Sheets

ELECTRICAL CONNECTOR HAVING GUIDE AND CENTERING AID

FIELD OF THE INVENTION

The present invention relates to an electrical connector composed of a plug connector and a mating connector, as well as guide and centering elements which cooperate with recesses.

BACKGROUND INFORMATION

Guideways and centering aids in the form of additional elements for electrical connectors, particularly for facilitating the manufacture of an electrical plug-in connection, are available.

Such guide elements are configured in such a way that, on the long sides and/or transverse sides of a plug connector, guide elements are provided which are rectangular in cross-section and which engage with recesses, provided in the mating connector, during the entire insertion process of the plug connector into the mating connector. These recesses are produced by so-called shaping bevels during plastics injection-molding processes. However, this necessitates that these recesses become ever narrower in the direction of the base of the mating connector, i.e., as the insertion operation advances, so that the plug connector itself is first centered shortly before the insertion operation is completed. This means that the conventional guide elements also have a centering function.

However, it is disadvantageous that the plug connector, which is inserted in the mating connector, is only centered in the base of the mating connector, since vibrational forces generally affect the entire connector. Thus, on the basis of the lever length between the starting point of the cable leading to the plug connector and the centering, a moment develops which can lead to the disengagement of the plug connector from the mating connector.

If the guide element is designed in such a way that the plug connector is guided in the mating connector over the entire insertion process, and in addition, centering elements are provided, then the position of the plug connector is statically over-defined. The result is that an exact, positionally-suitable disposition of the plug connector is not possible in this manner.

SUMMARY

An object of the present invention is to improve the cooperation of guide elements and centering elements of a plug connector with recesses which are provided in the mating connector.

To achieve this object, at least one recess is disposed on the mating connector and is dimensioned in such a way that, during the insertion of the plug connector into the mating connector, the guide element is guided in the recess and, in the inserted state, the recess is set apart from the guide element.

The design principle of the present invention is based on the fact that the plug connector is guided in a statically defined manner during the insertion process. After ending the insertion process, while the plug connector is resting on the connector base, centering elements retain the plug connector in the correct position in the mating connector, and at the same time, the guide elements provide no further function.

The guide elements may be composed of cam-like elements on the plug connector and guideway-like recesses on a mating connector. To ensure the functioning of such guideways according to the present invention, the cam-like formations are located in the immediate vicinity of the opening of the plug connector, so that when mounting the plug connector on the mating connector, the cam-like formations are placed in position in the guide-like recesses in the mating connector and glide in these guide elements. The electrical contacts in the plug connector and mating connector, respectively, can be exactly connected with one another without the plug connector tilting during the insertion process and thus possibly destroying one or more electrical contacts.

When the electrical contact between the plug connector and the mating connector is produced, then the plug connector is in an end position. In this end position, the recess of the guide element is dimensioned in such a way that the cam-like formation of the guide element is no longer guided by the recess. In this position, centering elements engage and retain the connector in the correct position in the mating connector. To this end, according to the present invention, centering elements are arranged particularly on the opposite side pointing away from the opening of the plug connector, i.e., in the inserted state, the centering elements are in the area of the opening of the mating connector. The centering elements may have a lug-like formation and position the plug connector by punctiform support locations in the mating connector.

DETAILED DESCRIPTION

Figure 1:
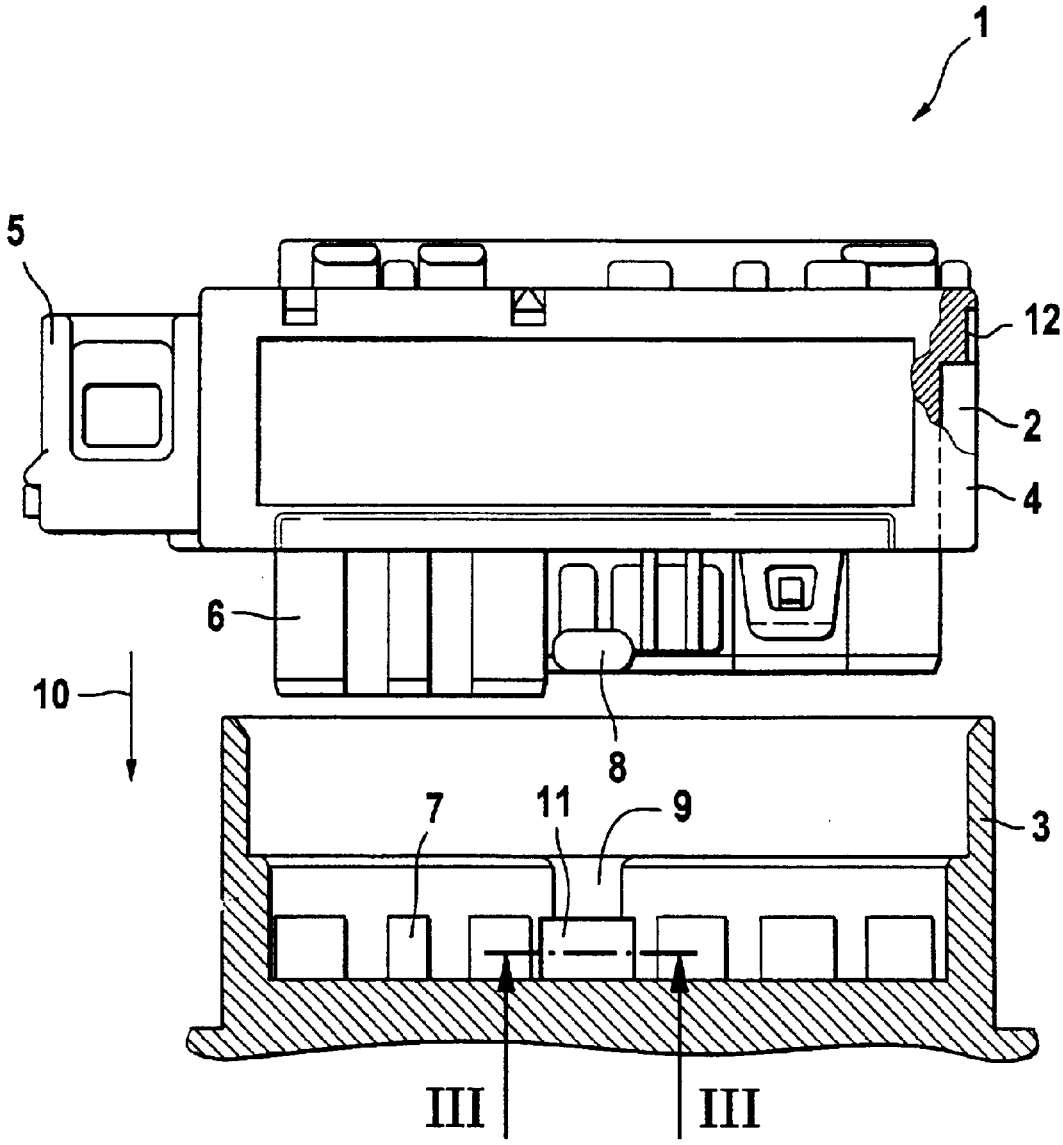
FIG. 1 shows a side view of the electrical connector according to the present invention immediately prior to the insertion process.

Connector 1 shown in FIG. 1 is made of a plug connector 2 and a mating connector 3. Plug connector 2 includes a housing 4 and a receptacle 5, for attaching a multicore electrical cable.

In the exemplary embodiment shown in FIG. 1, plug connector 2 has a plurality of plug-in contacts 6 which engage with further mating plug-in contacts 7 in mating connector 3.

Figure 2:
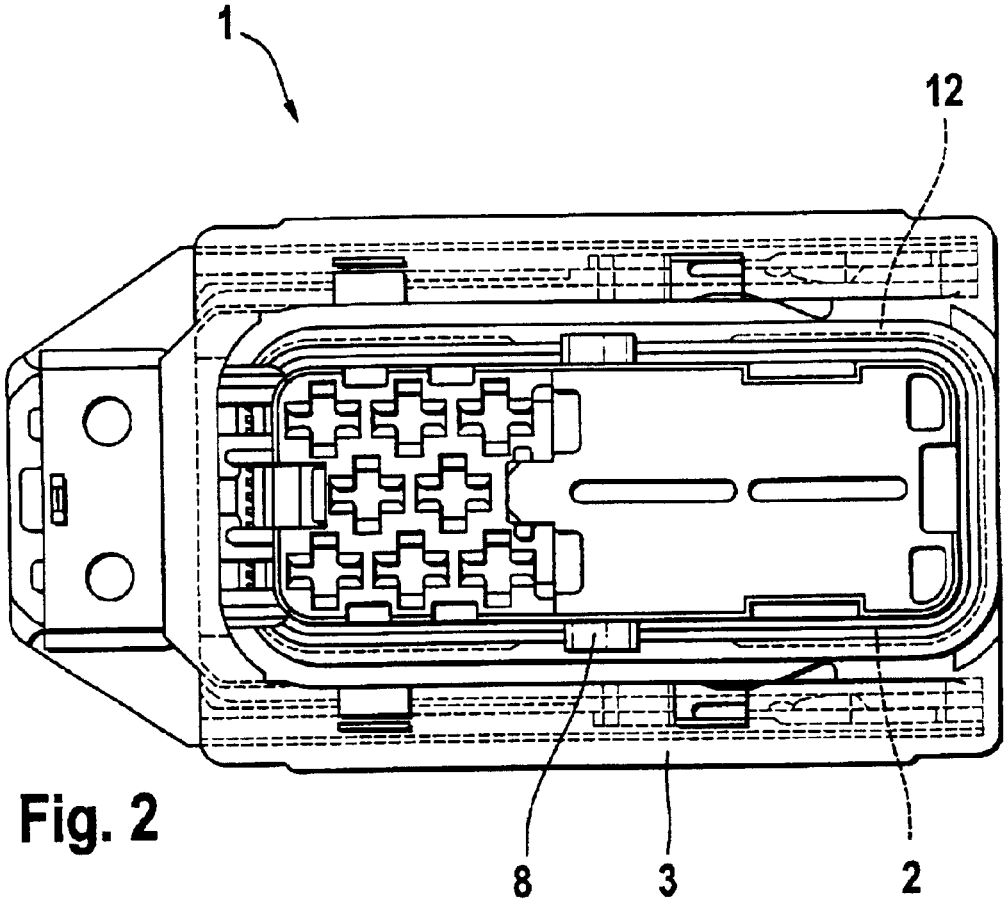
FIG. 2 shows a plan view of the connector according to FIG. 1 in the inserted state.
Figure 3:
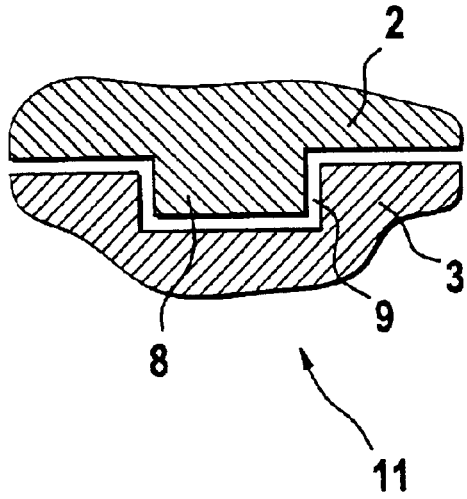
FIG. 3 shows a section through a guide element according to FIG. 1 along a line III—III.

After positioning plug connector 2 over mating connector 3 to produce an electrical plug-in connection, a cam-like guide element 8 arranged on housing 4 reaches into a recess 9 provided on mating connector 3. While producing the plug-in connection, in which plug connector 2 is guided into mating connector 3 in the direction of an arrow 10, cam-like guide element 8 glides along recess 9 until plug-in contacts 6 are brought into engagement with mating plug-in contacts 7. The guidance of cam-like guide element 8 in recess 9 is subsequently released, in that the cross-section of recess 9, particularly in a region 11 which is also shown in the cross-section in FIG. 3, is larger than the cross-section of guide element 8, so that cam-like guide element 8 is no longer immediately encircled by the walls of recess 9. When this position of plug connector 2 in mating connector 3 is reached, then in this exemplary embodiment, centering elements 12 shown in FIG. 2 position plug connector 2 in mating connector 3. In the exemplary embodiment, centering elements 12 are formed as a circumferential shoulder which is far distant from the base of mating connector 3 to thus prevent the development of any pitching moments of plug connector 2 in mating connector 3.

Due to the very simple design of guide elements 8 and centering elements 12 according to the present invention, plug connector 2 is introduced into mating connector 3 in a statically defined manner and without tilting and damage to plug-in contacts 6 and mating plug-in contacts 7, respectively, and is also positioned correctly after producing the connection. Centering elements 12 are advantageously arranged in such a way that, particularly in response to vibrational and shaking stresses, no pitching moments of plug connector 2 in mating connector 3 develop.

What is claimed is:

1. An electric connector, comprising:

a plug connector having a guide element;

a single composite mating connector having a recess, the recess being dimensioned so that during an insertion process of the plug connector into the mating connector, the guide element is guided into the recess, and in an inserted state, the recess is set apart from the guide element.

2. The electrical connector according to claim 1, wherein at least one of the plug connector and the mating connector includes a centering element.

3. The electrical connector according to claim 1, wherein the guide element has a cam-like form, the guide element being arranged in an immediate region of an opening of the plug connector.

4. The connector according to claim 1, wherein the guide element has rounded edges.

5. The electrical connector according to claim 1, further comprising:

at least one centering element arranged on a side opposite an opening of the plug connector, the at least one centering element configured to cooperate with the mating connector in the inserted state of the mating connector.

6. The connector according to claim 5, wherein the centering element has a lug-like form.

* * * * *